US006219425B1

(12) United States Patent
Watanabe

(10) Patent No.: US 6,219,425 B1
(45) Date of Patent: Apr. 17, 2001

(54) LOUDSPEAKER WITH HEAT RADIATING HOLE AND ELECTRICAL DEVICE EMPLOYING THE SAME

(75) Inventor: Shoji Watanabe, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/238,780

(22) Filed: Jan. 27, 1999

(30) Foreign Application Priority Data

Jan. 29, 1998 (JP) ..... 10-017518

(51) Int. Cl.[7] ..... H04R 25/00
(52) U.S. Cl. ..... 381/152; 381/429; 381/397
(58) Field of Search ..... 381/152, 306, 381/333, 388, 396, 397, 429; 361/687, 682, 683, 695

(56) References Cited

U.S. PATENT DOCUMENTS 4,551,849 * 11/1985 Kasai et al. ..... 381/152
5,748,760 * 5/1998 Button ..... 381/400
5,792,999 * 8/1998 Arnold et al. ..... 181/199
5,828,768 * 10/1998 Eatwell et al. ..... 381/333

FOREIGN PATENT DOCUMENTS 8-223678 8/1996 (JP) .

* cited by examiner

*Primary Examiner*—Huyen Le
(74) *Attorney, Agent, or Firm*—Sughrue, Mion, Zinn, Macpeak & Seas, PLLC

(57) ABSTRACT

A loudspeaker is superior in space saving ability for enabling down-sizing of a device, to which the loudspeaker is employed, and has frequency characteristics easily designed and adjusted. The loudspeaker includes a vibration plate formed with a plurality of heat radiating through openings, and a vibrating portion responsive to an input electrical signal and driving the vibration plate for generating an acoustic vibration.

8 Claims, 3 Drawing Sheets

LOUDSPEAKER WITH HEAT RADIATING HOLE AND ELECTRICAL DEVICE EMPLOYING THE SAME

BACKGROUND OF THE INVENTION

1. Field of the Invention

The present invention relates to a loudspeaker with a heat radiation hole suitable to be employed in a computer unit or other electronic devices which requires down-sizing or space saving, and electrical equipment employing such loudspeaker.

2. Description of the Related Art

Conventionally, as an electrical acoustic transducer (hereinafter referred to as speaker), there has been known those of the types called cone loudspeaker or, horn loudspeaker. There are various transducing principles to be employed in the loudspeakers. A cone loudspeaker as the most typical loudspeaker, is one called as dynamic direction radiation speaker. Such loudspeaker drives a cone by applying a signal current to a coil as a part of a vibration system held in a magnetic field of a permanent magnet 9 to generate an acoustic sound, as shown in a section of FIG. 3.

A frequency characteristic of the loudspeaker is variable depending upon a magnet 9, a coil 18, quality and shape of a cone 15, and supporting structure of the cone. In FIG. 3, the magnet 9 is fixed within a space defined by a yoke 10 and a yoke plate 11. The coil 18 is wound on a pole guide 19 for axial reciprocal motion relative to a pole piece 8. The cone 15 is fixed on a frame 12 at an outer periphery via a gasket 13 and an edge 14. An inner peripheral edge of the cone 15 is secured on the pole guide 19 and is elastically coupled with the frame by a damper 7. On the other hand, a cap 17 is provided at the center portion of the cone 15.

The cone loudspeaker constructed set forth above includes those having dome shaped or ribbon shaped vibration surface. In addition, there are loudspeakers applying an electrical signal between a stationary electrode and an electrically conductive film (vibration plate) stretched with a small gap from the stationary electrode for driving the film by variation of electrostatic force to cause vibration for radiating an acoustic vibration, as a static loudspeaker, electromagnetic type, piezoelectric type, ionic radiation type and so forth. These loudspeakers serve for converting electrical signal into acoustic vibration (audible sound).

In the meanwhile, in the electronic devices, such as recent personal computers or the like, a demand for a function to express information using high level image and/or sound adapting for increasing multimedia information, has been growing. Furthermore, due to grading up of information to be expressed, demanded specification for input/output performance and characteristics of video and audio information become higher progressively. Furthermore, in order to adapt for down-sizing demand of the overall system, it is required to integrally form a high performance loudspeaker with the electronic device.

However, when the conventional loudspeaker is integrally formed with the electronic device in integrating the high performance loudspeaker and the electronic device, large installation area and space becomes necessary for the speaker to make the overall device bulky. Also, in integration of the loudspeaker with the electronic device, constraints for shape and so on become quite severe to cause difficulty in obtaining desired output characteristics. Furthermore, since the casing and internal construction of the electronic device has to be optimized adapting demanded characteristics of the loudspeaker to be constraints for designing and manufacturing.

SUMMARY OF THE INVENTION

It is therefore an object of the present invention to provide a loudspeaker superior in space saving ability for enabling down-sizing of a device, to which the loudspeaker is employed, and an electronic device using the same.

Another object of the present invention is to provide a loudspeaker having frequency characteristics easily designed and adjusted.

According to the first aspect of the present invention, a loudspeaker comprising:

a vibration plate formed with a plurality of heat radiating through openings; and a vibrating portion responsive to an input electrical signal and driving the vibration plate for generating an acoustic vibration.

In the preferred construction, geometry of a plurality of heat radiating holes is selected depending upon a desired frequency characteristics of the loudspeaker. A physical property of a plurality of heat radiating holes may be selected for obtaining the selected geometry. In the alternative, a distribution of a plurality of heat radiating holes may be selected for obtaining the selected geometry. A size or shape of each individual heat radiating hole may be adjusting for obtaining the selected physical property of a plurality of heat radiating holes. An interval between mutually adjacent heat radiating holes may be selected for obtaining the selected distribution of a plurality of heat radiating holes, or in the alternative, number of heat generating holes to be formed through the vibration plate may be selected for obtaining the selected distribution of a plurality of heat radiating holes.

According to second aspect of the present invention, an electric device comprises:

a casing housing functional components therein;

a built-in loudspeaker including:

a vibration plate forming a part of wall of the casing, the vibration plate being formed with a plurality of heat radiating holes determining frequency characteristics of the loudspeaker and serving for radiating internal heat of the electric device; and a vibrating portion driving the vibration plate for generating an acoustic vibration.

The electronic device may further comprise a cooling fan for generating a cooling air flow across the functional components and to be discharged through the heat radiating holes.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessarily obscure the present invention.

Figure 1:
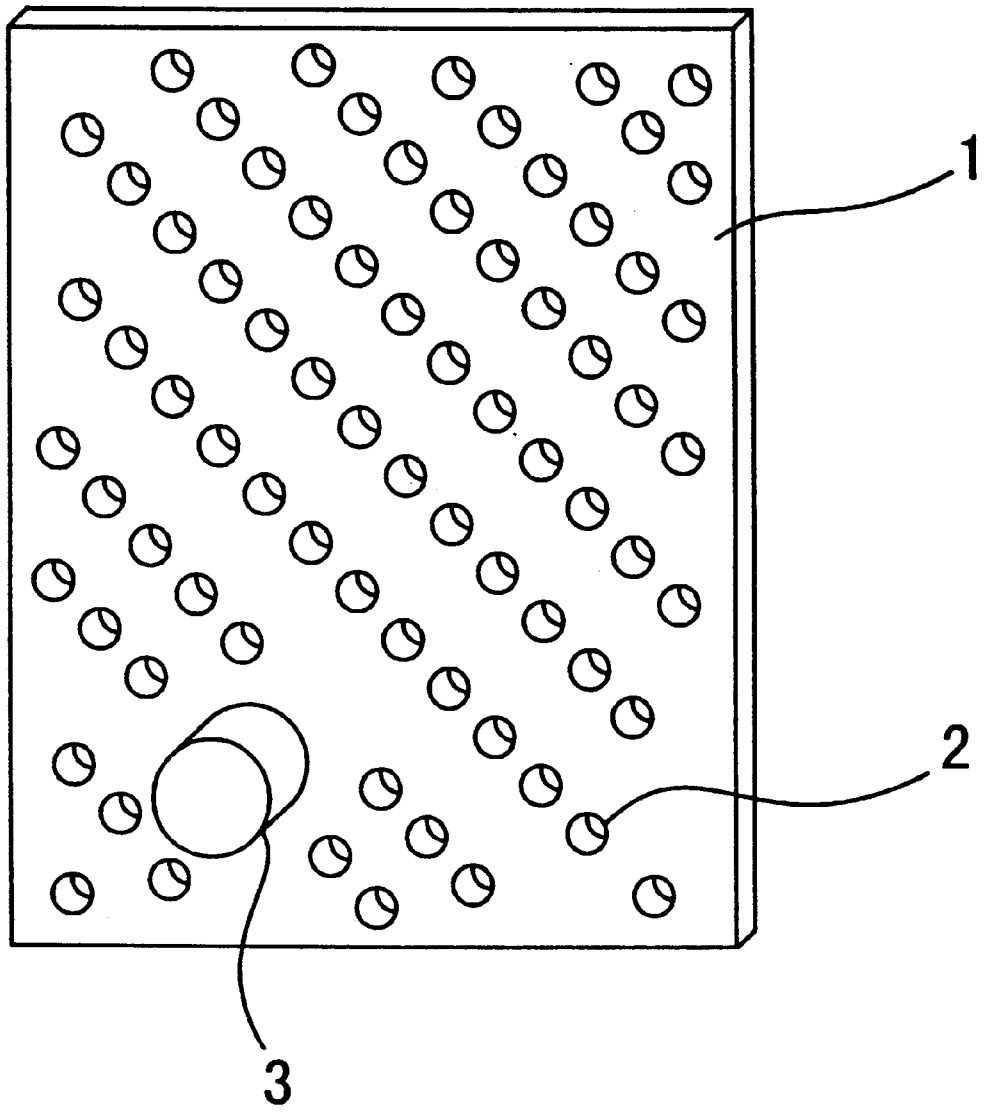
FIG. 1 is an external appearance of the preferred embodiment of a loudspeaker according to the present invention.
Figure 2:
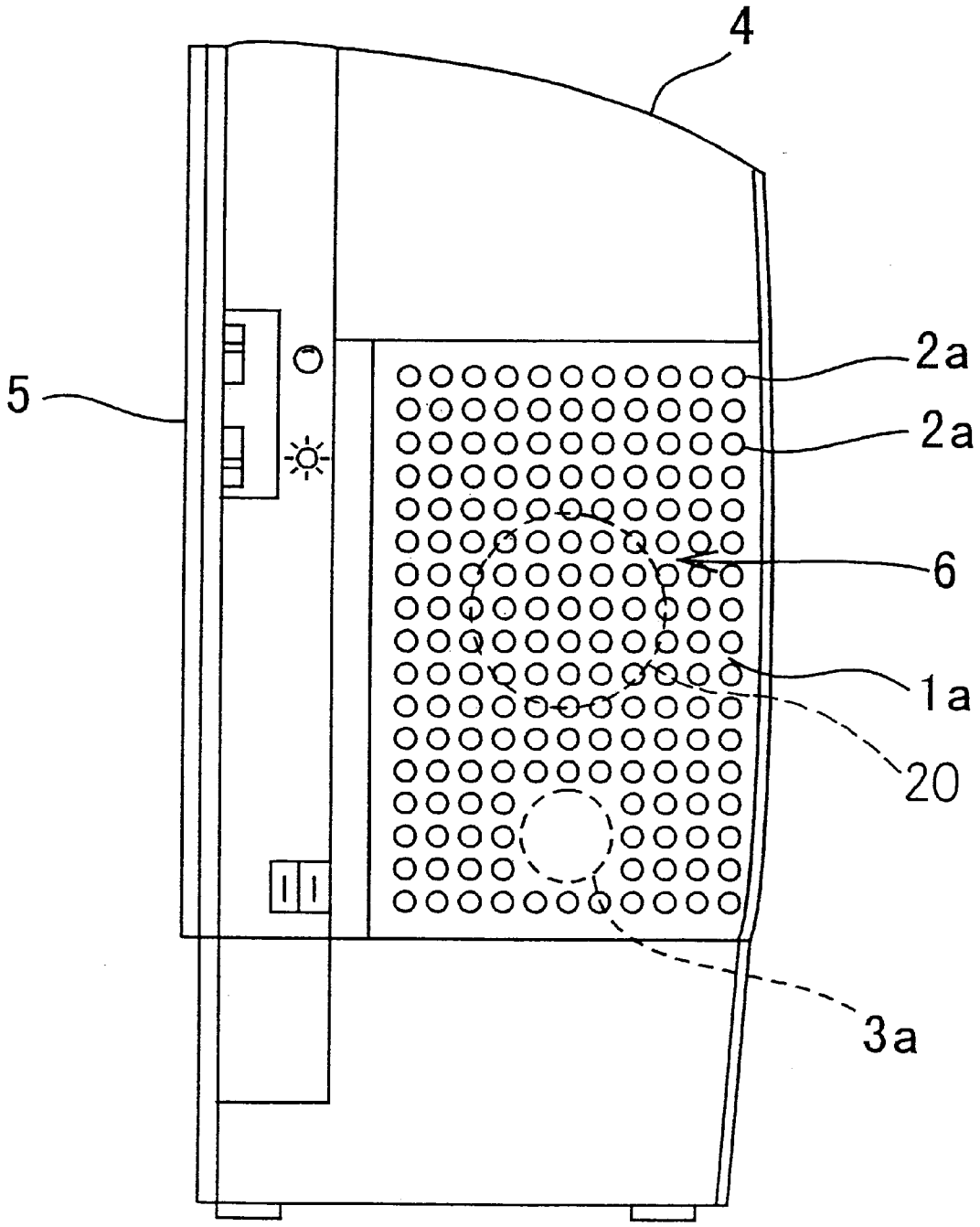
FIG. 2 is a side elevation of a desk-top computer employing the preferred embodiment of the loudspeaker shown in FIG. 1.
Figure 3:
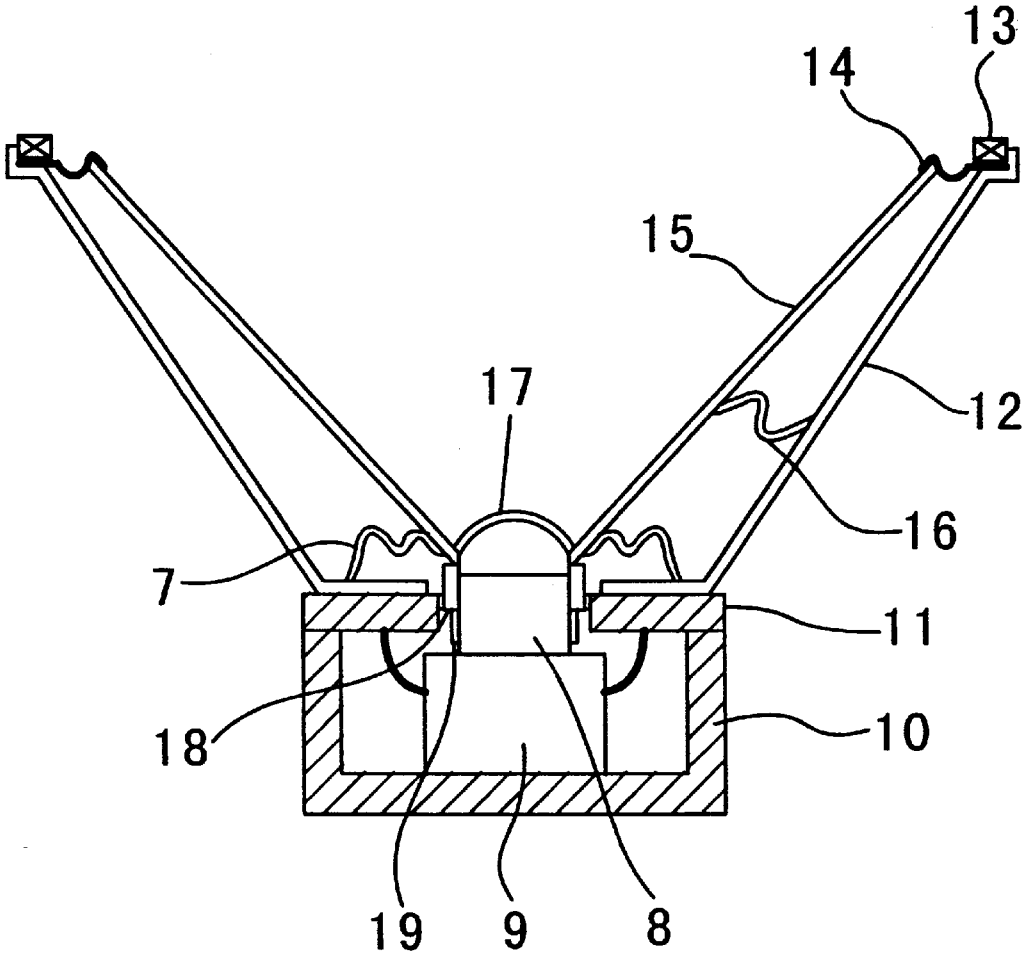
FIG.3 PRIOR ART
FIG. 3 is a side elevation of an example of the conventional loudspeaker (cone speaker).

FIG. 1 is an external appearance of the preferred embodiment of a loudspeaker according to the present invention, and FIG. 2 is a side elevation of a desk-top computer employing the preferred embodiment of the loudspeaker shown in FIG. 1. Referring to FIG. 1, the preferred embodiment of a loudspeaker has a vibration plate 1, in which a plurality of through holes serving as heat radiation holes 2, and a vibration system 3 serving as a driver for driving the vibration plate 1 for vibration. In the shown embodiment illustrated in FIG. 1, the vibration plate 1 is a flat plate form made of metal, synthetic resin and so forth, for example. The vibration system 3 converts an input electrical signal as audio signal into a pressure to cause vibration of the vibration plate 1. An electric drive type vibration system, a piezoelectric actuator and so forth may be used as the vibration system 3, for example.

The shape of vibration plate 1 in the shown embodiment of the loudspeaker of the present invention is not limited to the flat plate shape as in the shown embodiment but can be any shape as long as the heat radiation holes can be formed. For instance, the vibration plate 1 may be cone shape, horn shape and so forth. Namely, the feature of the present invention can be realized by forming the heat radiation holes through the vibration plate of any type of loudspeaker, such as cone loudspeaker and so forth. The loudspeaker of the present invention has essentially the same vibration plate as the conventional loudspeaker except that the heat radiation holes are provided. The present invention is not directed to the principle of conversion of the electrical signal, i.e. audio signal, into an acoustic vibration. Therefore, irrespective of the principle of conversion, the present invention is applicable for any loudspeakers having the vibration plate. Accordingly, kind and combination of the vibration plate and the vibration system is not limited to the construction shown in FIG. 1.

Size, position and number of the heat radiation holes 2 can be determined depending upon demanded specification in acoustic transducer characteristics and heat radiation. Furthermore, the heat radiation holes to be formed in one loudspeaker is not necessary to be uniform over the entire area of the vibration plate. By various combinations of the size, position, number of the heat radiation holes, and distribution of different shapes of the heat radiation holes, frequency characteristics of the loudspeaker can be adjusted by a designer of the electrical device.

It should be noted that the particular embodiment of the loudspeaker of the present invention as illustrated in FIG. 1 employs the flat vibration plate 1. Therefore, the shown embodiment is particularly effective for space saving.

FIG. 2 is a side elevation shown an external appearance of a space saving type desk-top computer 4 as an example of the electrical device employing the loudspeaker with the heat radiation holes according to the present invention. In the embodiment shown in FIG. 2, the loudspeaker 6 is constructed with a flat plate form vibration plate 1*a* formed with a plurality of heat radiation holes 2*a,* and a vibration system 3*a* for driving the vibration plate 1*a*. The loudspeaker is formed integrally with a side surface of a casing of the desk-top computer 4 having a liquid crystal display device 5 on a front surface. While not clearly illustrated in the drawings, another loudspeaker is similarly provided on the other side surface of the casing of the desk-top computer 4. Two loudspeakers on both sides serves as stereophonic loudspeakers. As set forth above, the heat radiation holes 2*a* are formed through the vibration plate 1*a*. Therefore, these heat radiation holes 2*a* serve as path of air for communication between outside and inside of the desk-top computer 4. Therefore, these heat radiation holes serve as heat generation holes of the desk-top computer 4.

It should be noted that an interval between the heat generation holes can be adjusted depending upon the frequency characteristics of the sound to be converted. On the other hand, size of a plurality of heat generation holes can also be adjusted adapting to the frequency characteristics of the sound to be converted. As well the, number of the heat radiation holes 2*a* can also be adjusted adapting to the frequency characteristics of the sound to be converted. In addition, by providing a cooling fan 20 within the casing of the desk-top computer and by using the heat radiation holes as discharge holes of the cooling air circulated by the fan, heat radiation efficiency can be further enhanced.

The size and shape of the heat radiation hole may be referred to as physical property of the heat radiating hole. The number of heat radiating holes to be formed through the vibration plate and the interval between adjacent heat radiating holes may be referred to as distribution of the heat radiating holes. The combination of the physical property and the distribution of the heat radiating holes may be referred to as geometry of the heat radiating holes.

As set forth above, since the heat radiation holes are provided in the vibration plate of the loudspeaker, the electrical device employing the loudspeaker according to the present invention, is not required to provide extra space for the heat radiation holes except for installation of the loudspeaker. Therefore, such a loudspeaker is particularly suitable for a portable compact computer, a space saving type desk-top computer and so forth. Secondly, since the frequency characteristics of the loudspeaker can be easily adjusted by adjusting the interval (distribution), size and number of the heat radiation holes, greater freedom can be attained.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A loudspeaker comprising:

a vibration plate formed with a plurality of heat radiating holes;

a vibrating portion responsive to an input electrical signal operative to drive said vibration plate for generating an acoustic vibration, and a cooling fan for generating a cooling air flow across functional components of said loudspeaker and to be discharged through said heat radiating holes.

2. A loudspeaker as set forth in claim 1, wherein a geometry of said plurality of heat radiating holes is selected depending upon a desired frequency characteristics of said loudspeaker.

3. A loudspeaker as set forth in claim 2, wherein a physical property of said plurality of heat radiating holes is selected for obtaining the selected geometry.

4. A loudspeaker as set forth in claim 3, wherein a size of each individual heat radiating hole is adjusted for obtaining the selected physical property of said plurality of heat radiating holes.

5. A loudspeaker as set forth in claim 2, wherein a distribution of said plurality of heat radiating holes is selected for obtaining the selected geometry.

6. A loudspeaker as set forth in claim 4, wherein an interval between mutually adjacent heat radiating holes is selected for obtaining the selected distribution of said plurality of heat radiating holes.

7. A loudspeaker as set forth in claim 4, wherein a number of said heat generating holes to be formed through said vibration plate is selected for obtaining the selected distribution of said plurality of heat radiating holes.

8. An electric device comprising:

a casing housing functional components therein;

a built-in loudspeaker including:

a vibration plate operative to form a part of a wall of said casing, said vibration plate being formed with a plurality of heat radiating holes operative to determine frequency characteristics of said loudspeaker and radiate internal heat for said electric device;

a vibrating portion operative to drive said vibration plate for generating an acoustic vibration; and a cooling fan for generating a cooling air flow across said functional components and to be discharged through said heat radiating holes.

* * * * *